United States Patent [19]

Ogawa

[11] 3,947,134

[45] Mar. 30, 1976

[54] DEVICE FOR DISPENSING MOISTENED HOT CLEANSING TISSUES

[75] Inventor: Yonekichi Ogawa, Tokyo, Japan

[73] Assignee: Maruwaseiko Kabushiki Kaisha, Tokyo, Japan

[22] Filed: Feb. 24, 1975

[21] Appl. No.: 552,720

[30] Foreign Application Priority Data

May 27, 1974 Japan ..... 49-58720
July 18, 1974 Japan ..... 49-81719

[52] U.S. Cl. ..... 401/118; 118/302; 118/325; 219/297; 219/314

[51] Int. Cl.[2] ..... B05B 13/02; B05C 5/02

[58] Field of Search ..... 222/146, 451, 452; 221/96, 221/135; 219/297, 314; 118/302, 315, 325; 134/105, 90, 107, 122; 401/1, 118, 123, 130

[56] References Cited

UNITED STATES PATENTS

| | | | |
|---|---|---|---|
| 2,044,284 | 6/1936 | Dargavel | 221/135 X |
| 2,568,474 | 9/1951 | Van Sciver | 222/146 HE X |
| 3,862,616 | 1/1975 | Brady | 118/315 X |
| 3,865,271 | 2/1975 | Gold | 221/96 |

*Primary Examiner*—Robert B. Reeves
*Assistant Examiner*—Francis J. Bartuska
*Attorney, Agent, or Firm*—Haseltine, Lake & Waters

[57] ABSTRACT

A device for dispensing moistened cleansing tissues. The device provides cleansing tissues which have been moistened with a predetermined and definite quantity of heated water. The device includes a hot water heater for heating the water to an appropriate temperature, a water supply tube for supplying unheated water to said hot water heater, a water discharge tube for discharging properly heated hot water onto serially arranged cleansing tissues, and a throttling mechanism for alternately throttling said tubes for the purpose of controlling the supply of water to said heater and the discharge of heated water therefrom.

7 Claims, 11 Drawing Figures

DEVICE FOR DISPENSING MOISTENED HOT CLEANSING TISSUES

BACKGROUND OF THE INVENTION

This invention relates to hot water supplying devices and more particularly to such devices which are adapted to supply a predetermined definite volume of properly heated water to cleansing tissue such as toilet paper.

It is a common experience to feel comfortable and clean following a bowel movement providing the excretion is clearly removed from the body. However, it is often difficult for one to remove such excretions in the usual way. This results in the lack of cleanly feelings. Im some instances, such difficulty makes anal fistula patients worse in their disease and frequently causes inflamations among infants.

In such circumstances, one can sometimes enjoy a feeling of cleanliness by resorting to the use of a steamed towel, or the like properly moistened with hot water.

SUMMARY OF THE INVENTION

Accordingly, the principal object of the present invention is to provide a device for dispensing cleansing tissues which is adapted to automatically provide such tissues moistened with a predetermined volume of properly heated water.

Another object of the present invention is to provide a device of the character described above which is capable of preventing the excessive wetting of the tissues by positively blocking a hot water supply tube after a definite volume of hot water has been supplied therethrough to the cleansing tissues.

A further object of the present invention is to provide a device of the character described which is capable of promptly heating water in a water tank to a predetermined appropriate temperature in preparation for the moistening of the tissues.

A still further object of the present invention is to provide a device of the character described in which the volume of hot water to be applied to the tissue is readily adjustable.

A still further object of the present invention is to provide a device of the character described in which, even after hot water has been repeatedly applied to sheets of tissues, relatively cool water which has not yet been heated to the appropriate temperature, will not be supplied thereto.

According to the present invention there is provided a device for serially dispensing cleansing tissues or the like which have been moistened to a predetermined degree with heated water, comprising a frame, a reservoir mounted within said frame for the storage of relatively cool water, a hot water heater positioned in said frame below said reservoir adapted to receive cool water from said reservoir and to discharge water therefrom heated to a predetermined temperature, a flexible water supply tube connecting said reservoir and said hot water heater, a flexible hot water discharge tube being mounted in said hot water heater with the upper end thereof projecting thereinto a preselected distance, a hot water supply chamber being located in said frame below said hot water heater and the lower end of said hot water discharge tube extending into said chamber, an oscillatable throttling means being mounted within said frame adapted to oscillate between a first position whereby it constricts the passageway of said hot water discharge tube to prevent the discharge of hot water therefrom and a second position whereby it constricts the passageway of said water supply tube to prevent the flow of relatively cool water from said reservoir to said hot water heater, and means for storing a plurality of cleansing tissues and for moving same in a path within said frame whereby they are moistened by the hot water before being dispensed.

The above and other objects, features and advantages of the present invention will become apparent from the following description when taken in conjunction with the accompanying drawings, which show a preferred embodiment of the invention.

BRIEF DESCRIPTION OF THE DRAWINGS

In order that the invention may be more fully comprehended it will now be described, by way of example, with reference to the accompanying drawings in which:

FIG. 6 is a view similar to FIG. 4, showing the throttling mechanism in the state assumed when water is being supplied to a water tank;

FIG. 7 is a front elevation of the hot water heater and its associated parts, showing the same state as shown in FIG. 6;

FIG. 8 is a view similar to FIGS. 4 and 6, but showing the throttling mechanism in a state assumed when water is being discharged from the water tank;

FIG. 9 is a longitudinal sectional view of the hot water heater and its associated parts, showing the same state as shown in FIG. 8;

FIG. 10 is a view similar to FIGS. 4, 6, and 8, showing the throttling mechanism in the state assumed when it is being restored from the water discharge state shown in FIGS. 8 and 9 to the water supply state shown in FIGS. 6 and 7.

DETAILED DESCRIPTION OF THE INVENTION

Figure 1:
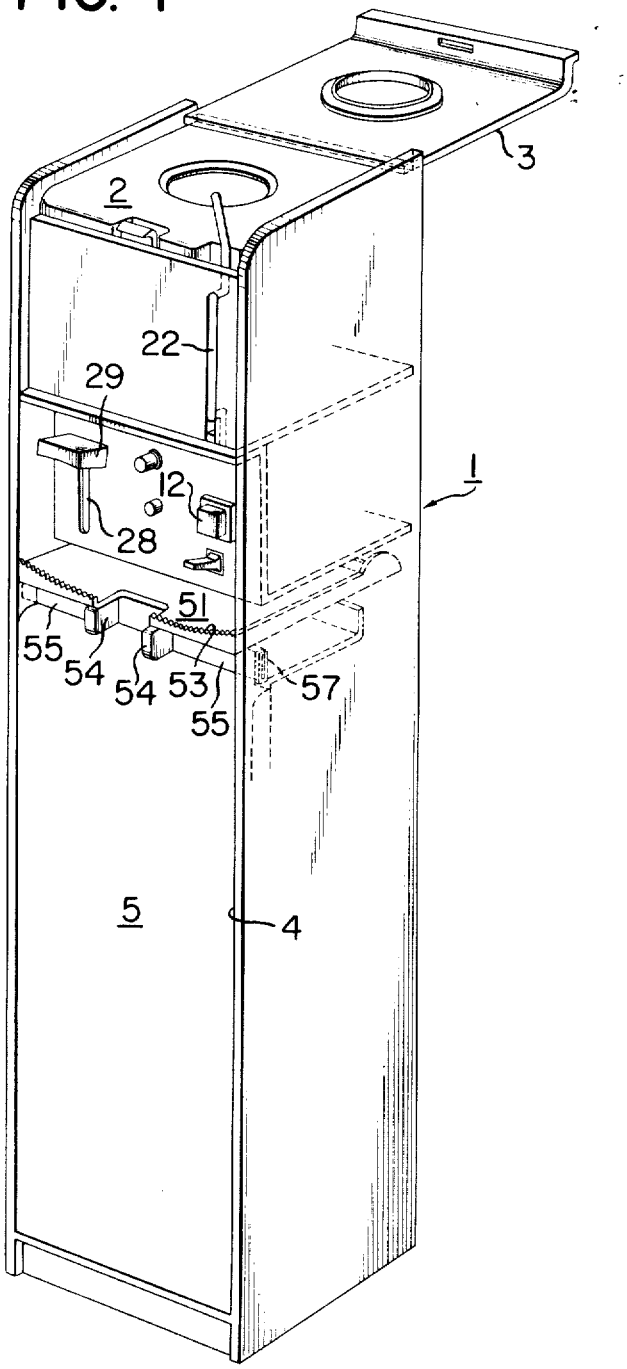
FIG. 1 is a perspective view of a tissue dispensing device embodying the present invention.

Referring to the drawings, reference numeral 1 is a frame incorporating therein the device of the present invention, and having its open top end enclosed by an enclosure member 3 swingably hinged thereto for opening or closing thereof. A water reservoir 2 is removably accommodated in the upper portion of the frame 1 for storing clean water, disinfectant solutions or the like, so that it can be easily removed from the frame by opening the enclosure member 3. A hot water producing chamber A and a hot water supply chamber B are provided immediately below the water reservoir 3 in the frame 1. Also provided in the frame immediately below the hot water supply chamber B is a downwardly elongated chamber C for the accommodation of a series of cleansing tissues P, the chamber C opening at the front for removably accommodating therethrough a container 5 for the tissues P.

Figure 3:
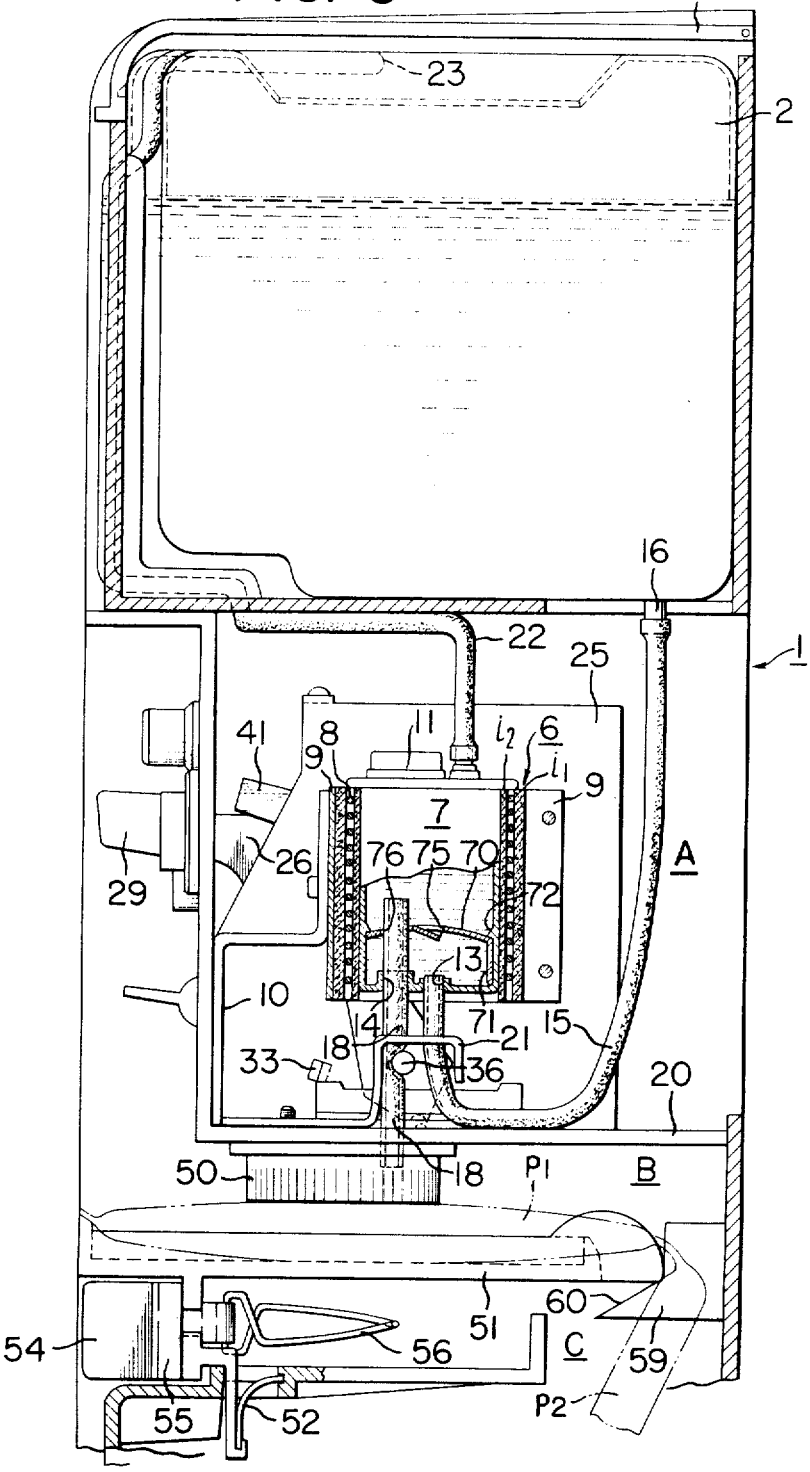
FIG. 3 is an enlarged view, in longitudinal section, of the essential parts of the device.

As shown in FIG. 3, supported at the central portion of the chamber A by means of a bracket 10 fixed to the frame 1, is a hot water heater indicated generally at 6, composed of a cylindrical tank 7 and an electrical heater or resistance wire 8 enclosing the outer peripheral surface of the tank 7. The tank and resistance wire are surrounded by a pair of insulator layers $i_1$, $i_2$, and the outer peripheral surface is tightly braced by a bracing band 9 fixed to the bracket 10. Thus, the hot water heater is rigidly secured to the bracket and hence to the frame. As detailed later, the clean water or disinfectant solution contained in the tank 7 is heated by the operation of the heater 8 to a predetermined appropriate temperature, e.g., 40° – 70°C, and when such a temperature level is reached a thermostat 11, mounted on the top of the tank 7, operates to shut off the heater 8. Simultaneously a pilot lamp 12 (FIG. 1) arranged on the outer front surface of the frame is illuminated.

At the bottom of the water tank 7 are provided an inlet port 13 and an outlet port 14, into the former of which the lower end of a J-shaped flexible water supply tube 15 formed of a suitable heat-resisting material such as a silicon tube is inserted. The upper end of the tube 15 is connected to an outlet pipe 16 integrally formed with the water reservoir 2 and projecting downwardly from the bottom thereof, so that water in the water reservoir 2 can be supplied to the tank 7 through the tube 15. Both the lower end of tube 15 and the upper end of the tube are appropriately sealed relative to the inlet port and outlet pipe to prevent leakage of water from the joints thus formed.

A water discharge tube 18 of the same material as the water supply tube 15 is vertically adjustably inserted into the outlet port 14 at the bottom of the water tank 7, tube 18 opening at its upper end into the interior of the tank 7 at an appropriate height above the bottom thereof, while extending downwardly to open at its lower end into the hot water supply chamber B.

The water supply and discharge tubes 15, 18 are preferably kept water-sealed at the inlet and outlet port 13, 14 under the action of their own resiliency so that there is no danger of water leakage through the ports as stated above.

Figure 11:
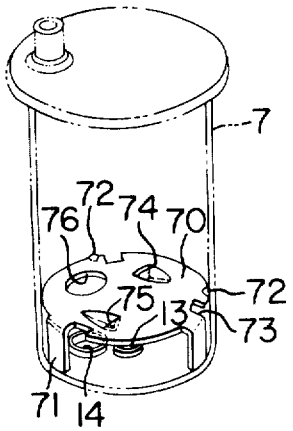
FIG. 11 is a perspective view of a vortex generator plate of the device mounted within a water tank.

As illustrated in FIG. 11, mounted in the tank 7 at the lower portion thereof is a vortex generator plate 70 which is slightly smaller in diameter than the tank 7. The plate 70 has several integral legs disposed on the bottom of the tank 7 so that the plate 70 can be maintained at a definite distance from the tank bottom. The tank 7 is formed on its interior surface with a small number of projections 72 which serve, in cooperative engagement with the vortex generator plate 70, to fix the plate in place within the tank 7. The vortex generator plate 70 is provided about its periphery with the same number of recesses 73 as there are projections 72. The recesses, when aligned with projections 72, serve to enable the plate 70 to be set into the tank 7. After having been set in place the vortex generator plate 70 is rotated slightly so as to stagger the recesses and projections and thereby prevent vertical movements of the plate 70.

Connected to the top of tank 7 is a transparent, flexible airvent tube 22 which extends laterally and then upwardly along the outer surface of the water reservoir 2, opening at its upper end into the atmosphere for the purpose of venting air in the tank 7. The middle portion of tube 22, extending upwardly along the side wall of tank 7, is exposed exteriorly of the frame 1, so that the user of the device can visually determine the vertical level of water in the reservoir 2 from the outside of the device. As described later, the user can also visually ascertain whether the interior of the tank 7 has been filled up with water.

The water supply tube 15 and the water discharge tube 18 are alternately throttled or blocked intermediate their ends immediately below the bottom of the tank 7 by virtue of a throttling mechanism *a*, which will be described below.

Figure 4:
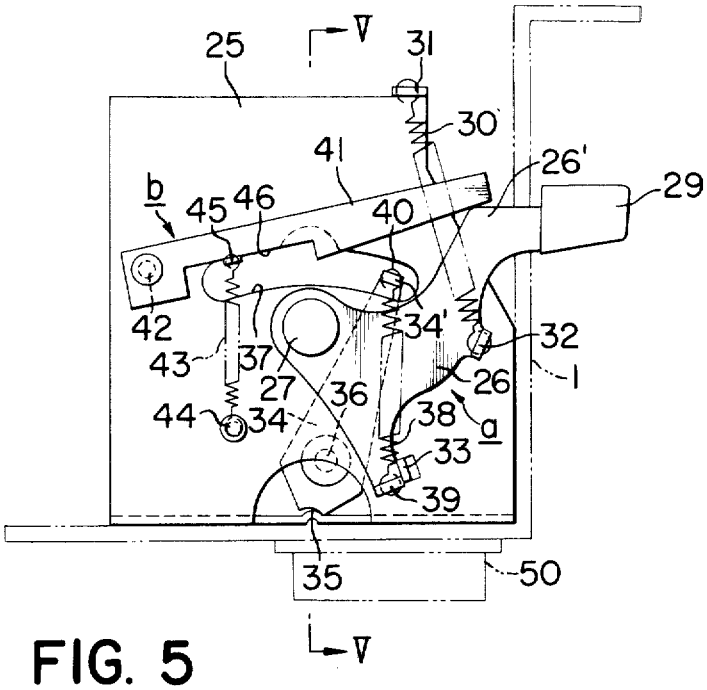
FIG. 4 is a front elevational view of a throttling mechanism employed with the device, taken from the back side of FIG. 3.
Figure 5:
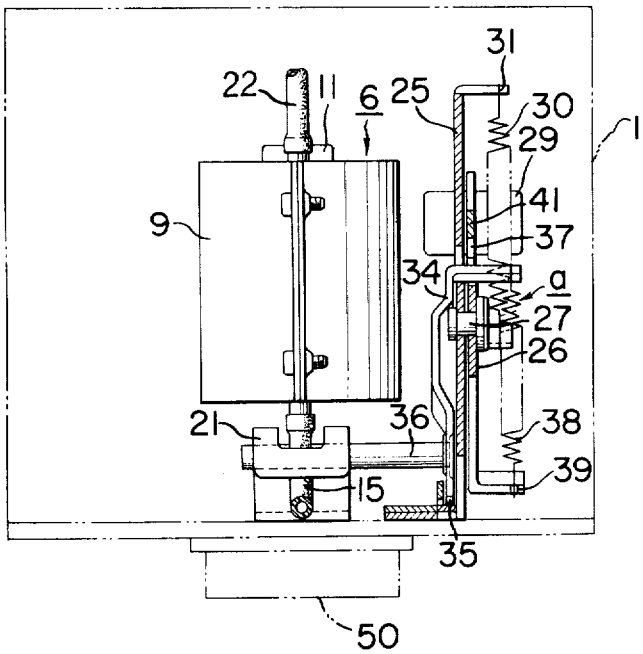
FIG. 5 is a longitudinal sectional view of the throttling mechanism, taken along the line V—V of FIG. 4 and additionally showing a hot water heater and the associated parts thereof.

Describing the throttling mechanism *a* mainly with reference to FIGS. 4 and 5, there is shown a retainer plate 25 vertically mounted within the hot water producing chamber A, to which plate is pivoted a knee-shaped operating lever 26 at its knee portion. As depicted the operating lever takes the form of a bell crank. One end of the operating lever 26 extends exteriorly of the frame 1 through a slot 28 (FIG. 1) formed therein, and a push button 29 is fixedly attached thereto for manual actuation. Connected to the operating lever 26 at a location 32 near the push button side thereof is one end of a return spring 30, the other end of which is fixed at 31 to the retainer plate 25. The return spring 30 acts to bias the operating lever 26 towards rotation in the counterclockwise direction about a pivot pin 27 until the lower end of the lever 26 engages a stopper 33 of the retainer plate 25, as clearly shown in FIG. 4.

At the backside of the retainer plate 25, there is provided a rocker arm 34, the lower end of which is pivoted at 35 for rocking movement to the right and left and which has a throttling bar 36 fixedly secured to the basal or lower portion thereof, the bar 36 extending substantially horizontally between the water supply and discharge tubes 15, 18, arranged immediately below the tank 7 in parallel relation with each other, so as to be oscillatable for the purpose of alternately throttling the tubes 15, 18 in cooperation with the inverted J-shaped stopper element 21. The upper or free end of the rocker arm 34 is bent or hooked substantially perpendicularly so that the bent end 34' of the rocker arm 34 can be rockably fitted into an arcuated aperture 37 formed in the retainer plate 25. The bent end thus projects therethrough slightly beyond the front surface of the plate 25 for connection with a tension spring 38 secured to the lower end of the operating lever 26, the arrangement being such that rotation of the operating lever 26 about pivot pin 27 causes the rocker arm 34 to rock to the right or left about a pivotal point 35 through the action of the tension spring 38 arranged between the rocker arm 34 and the operating lever 26. Pivotally secured to the retainer plate 25 near its one side is a force accumulating lever 41 having a recess 46 formed in the underside thereof for engagement at one edge thereof with the hooked end 34' of the rocker arm 34. A positioning spring member 43, weaker than the tension spring 30, is provided between the medial portion of the force accumulating lever 41 and a lower appropriate point of the retainer plate 25 for the purpose of urging the lever 41 downwardly or in a clockwise direction about a pivotal point 42 into engagement with the shoulder portion 26' of the operating lever 26.

Thus, both the force accumulating lever 41 formed with the recess 46 and the positioning spring member 43 constitute a springforce accumulating means *b* for the tension spring 38.

Attached to the underside of the bottom wall 20 of the hot water producing chamber A, (see FIG. 3), is a resilient ring member 50 made of rubber or the like material, which extends downwardly within the hot water supply chamber B and encircles the lower end of the water discharge tube 18, for prevention of splattering or overspreading of the hot water discharged from the water discharge tube 18. The ring member 50 is provided at the lower portion with a number of longitudinal slits for easy deformation thereof.

Support means such as a tray 51, for receiving one or more of a series of cleansing tissues P is vertically movably mounted on the top of the storage container 5 by means of a leaf spring 52, the tray being integrally formed at its front edge with a cutter 53 for cutting the tissues after they are dispensed (see FIG. 1). Support means 51 is integrally formed near the forward end with a downwardly depending or extending projection in which are laterally slidably mounted a pair of retainer pieces 55, (see FIG. 3), which are biased by a spring member 50 to move outwardly away from each other into mating or nesting engagement with a pair of grooves 57 formed in the opposite side walls of the frame 1.

Fitted within the tissue-receiving chamber C is a wrapper 58 accommodating a series of tissues P with its component segments $p_1, p_2, \ldots p_n$ continuously connected with eech other and folded one over the other in zigzag form.

Figure 2:
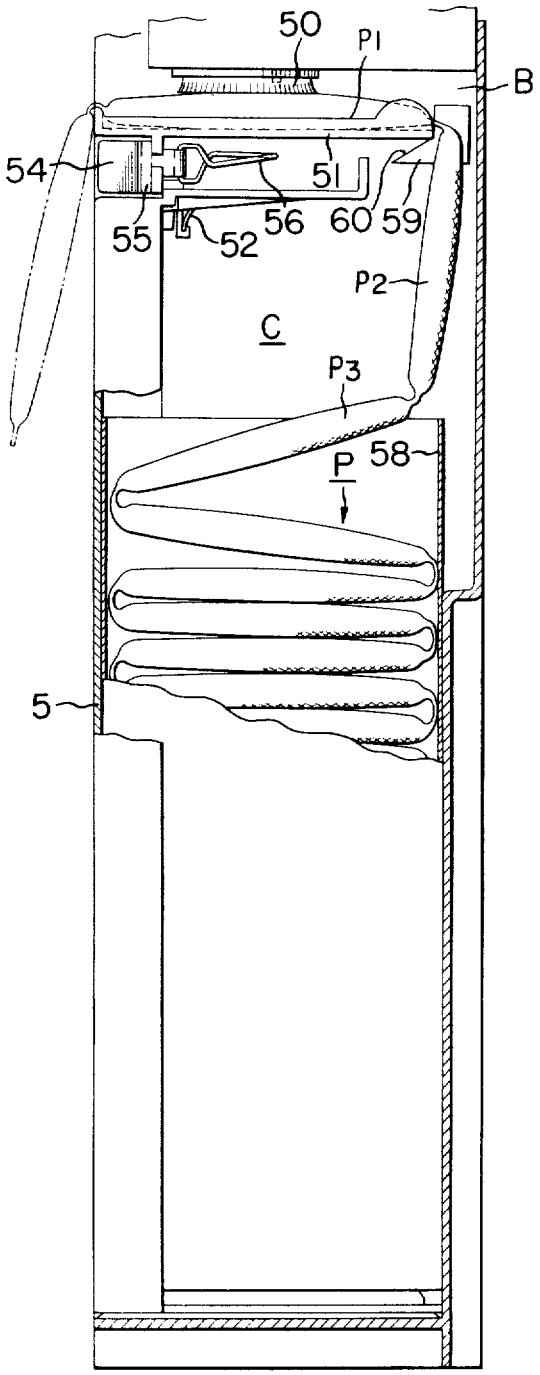
FIG. 2 is a partly broken, enlarged side elevational view of FIG. 1.

As illustrated in FIGS. 1 and 2, after the user has positioned storage container 5 in chamber C the retainer pieces 55 are caused, under the action of spring member 56 to engage to grooves 57 thereby fixing the position of container 5 within the frame. The inner or rear end of the support means 51 thus rests upon slanting surface 60 of a bearing piece 59 and is kept in a substantially horizontal state.

Segments $p_1, p_2, \ldots p_n$ of the tissues P can be drawn from the wrapper 58, passing through the rear end of the tray 51, so as to rest thereon.

The container 5 can be easily removed from the frame by pulling together inwardly extending projections or tongues 54 of the retainer pieces 55 so as to release them from the grooves 57 in the opposite side walls of the frame 1.

The operation of the device will now be described with particular reference to FIGS. 6 through 10.

Figure 6:
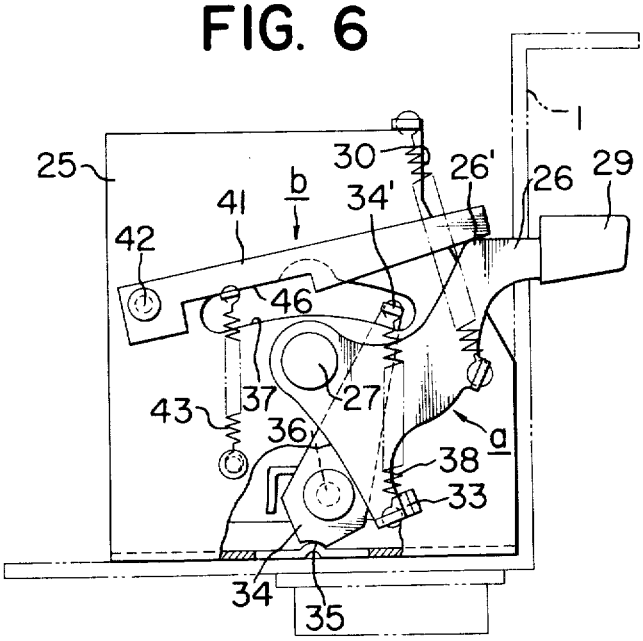
FIGS. 6 through 10 are views illustrating various operative states of the device.

When the device is not in use, or when no operational force is exerted upon push button 29 of the operating lever 26, the lever 26 will be normally biased by the force of spring 30 to rotate counterclockwise about the pivot pin 27 until the lower end of the operating lever 26 is brought into engagement with the stopper 33, as shown in FIG. 6. In this state, the rocker arm 34 is urged under the action of tension spring 38 to rotate clockwise about the pivotal point 35 until the bent end 34' of the rocker arm 34 reaches the right-hand end of the arcuate aperture 37, also as shown in FIG. 6. Consequently, the throttling bar 36, fixedly secured to rocker arm 34, pushes the water discharge tube 18 against the stopper 21 to block the flow of hot water from tank 7, while the water supply tube 15 is free from being throttled so that water can flow freely from the water reservoir 2 through the tube 15 to the tank 7. The water entering tank 7 impinges against the vortex generator plate 70 and disperses in various directions to intermix with the previously heated relatively hot water in the tank 7 below the plate 70. Then, the mixture of relatively cool and hot water flows upwardly through a pair of oppositely directed diametral openings 74, 75 formed in the plate 70 and into the upper portion of tank 7, simultaneously generating vortical flow thereby to rise, and then comingle with the previously heated water remaining therein.

In this connection, it should be noted that the intended purpose of the vortex generator plate 70 is to prevent relatively cool water, freshly supplied from the water reservoir 2 to the tank 7, from directly entering the upper portion of the tank 7 above the vortex generator plate 70. In this manner it is assured that relatively hot water will always be discharged from the tank 7 onto the tissues even when the device is used continuously or frequently at relatively short intervals.

As the interior of the tank 7 is vented through the transparent air-escape tube 22 into the atmosphere, the flow of water from water reservoir 2 to tank 7 is effected smoothly, and it is also possible to visually determine from the outside of the device whether tank 7 is filled up with water, by observing that portion of the tube 22 which extends upwardly along the forward wall of the reservoir 2 and which is exposed to the outside of the frame 1.

Further, as the water discharge pipe 18 is vertically adjustably inserted into the bottom of the tank 7, the volume of hot water to be discharged from the tank 7 may be varied in accordance with the user's requirements simply by adjusting the height of the pipe 18 above the bottom of the tank 7.

Figure 7:
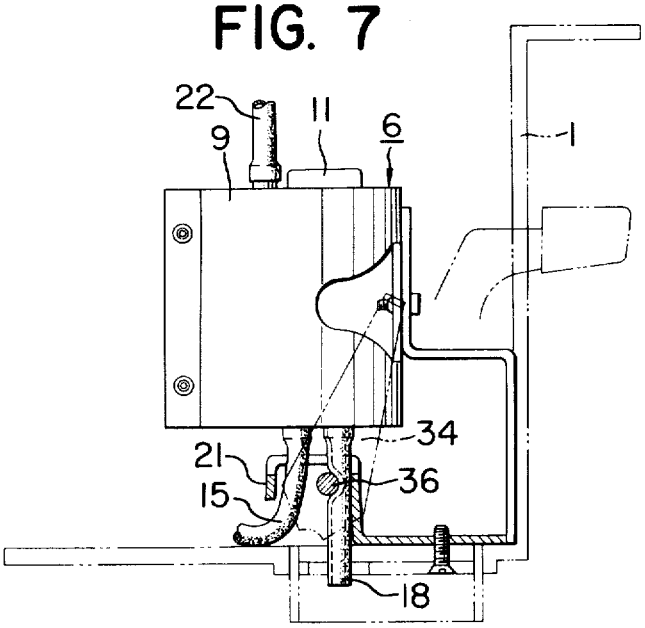
Figure 8:
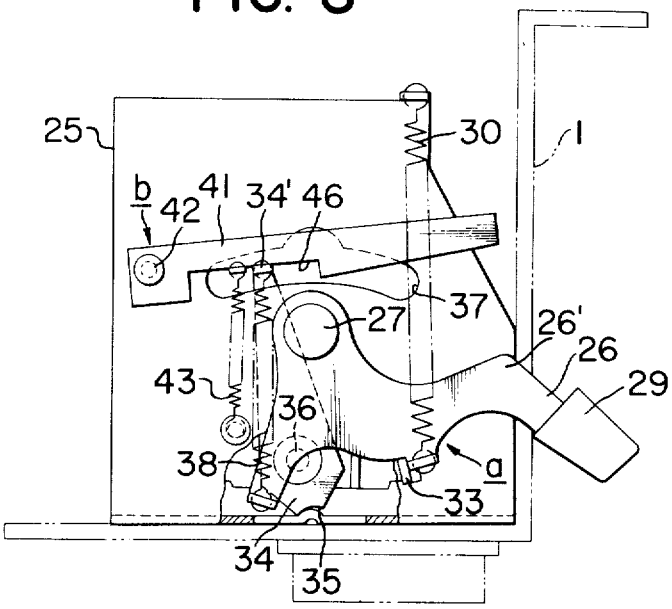
Figure 9:
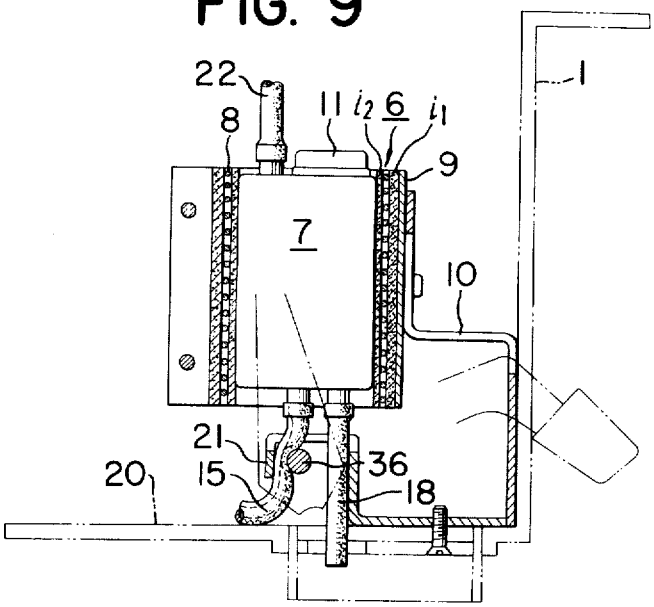
Figure 10:
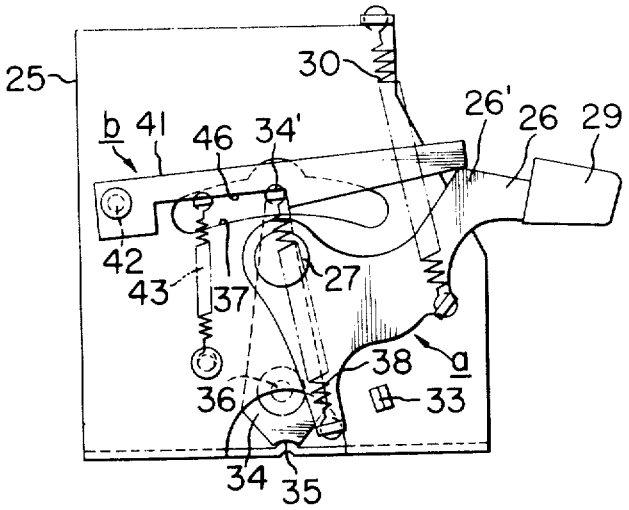

Upon removal of the manual force on push button 29 the operating lever 26 is restored under the action of the return spring 30 to its initial position, simultaneously returning the rocker arm 34 to its initial position through the intermediary of the tension spring 38. As illustrated in FIGS. 6 and 7, the throttling bar 36 thus operates to once again throttle the water discharge tube 18 while at the same time reestablishing fluid communication between the water reservoir 2 and the tank 7 so as to permit the feeding of fresh water from the former to the latter. In this connection, during the return movement of the rocker arm 34 to its initial position, i.e., from the position of FIG. 8 to that of FIG. 6, the bent end 34' of the rocker arm 34 engages the right-hand edge of the recess 46, formed in the underside of the spring-force accumulating lever 41, to be instantaneously and momentarily stopped in its movement thereby permitting the tension spring 38 to accumulate or restore for a second its spring force. Subsequently thereafter, the shoulder portion 26' of the operating lever 26, continuing to move upwardly, acts to push up the lever 41 to thereby release the upper bent end 34' of the rocker arm 34 from the recess 46 of the lever 41, thus enabling the rocker arm 34 to commence moving again rapidly in the clockwise or rightward direction under the influence of the now accumulated force of the tension spring 38. This eliminates the tendency for a tardy return motion of the rocker arm 34, accordingly assuring the complete throttling of the water discharge tube 18 by means of the throttling bar 36 and preventing the flow of hot water from the tank 7.

In this manner, a fraction $P_1$ of a series of tissues P on support means 51 is supplied with properly heated water in a predetermined definite amount and is ready for the aforementioned uses. The user can obtain a thus moistened tissue simply by pulling it out from the frame 1 and by separating same from the following tissues with the aid of cutter 53.

As will be apparent from the foregoing description, by a simple one-touch operation of the operating lever 26 it is possible according to the present invention to alternately throttle the water supply tube 15, which communicates between the water reservoir 2 and tank 7, and the water discharge tube 18, which opens at the upper end into the tank 7 and at the lower end into the hot water supply chamber B, thereby enabling a predetermined, definite volume of properly heated water to be supplied to cleansing tissues or the like to moisten such tissues to the desired degree of wetness.

According to another aspect of the invention, upon throttling the water discharge pipe 18, the throttling bar 36 is momentarily arrested in its movement to thereby effectuate a partial accumulation of the spring force of tension spring 38, so that it can thereafter be moved swiftly under the action of such accumulated spring force thereof to a position of complete throttling of the water discharge pipe 18.

According to a further aspect of the invention, the time required for heating the water in the tank 7 to an appropriate temperature is reduced to a substantial extent due to the fact that the water discharge pipe 18 is positioned into tank 7 at an appropriate height above the bottom thereof so as to permit a portion of previously heated hot water to remain in the tank 7 after discharge thereof and to comingle with relatively cool water freshly supplied from the water reservoir 2. Additionally, the volume of hot water to be discharged from the tank 7 is easily adjustable as desired by changing the height of the water discharge pipe 18 above the bottom of the tank 7.

According to a still further aspect of the invention, upon the entrance of water from the water supply tube 15 into the tank 7 the entering water impinges against the vortex generator plate 70 and then disperses in various directions to flow through a pair of diametrically opposite openings 74, 75 formed in the plate 70, generating or converting to vortex flow and thereby pushing up a mass of previously heated hot water in the tank 7 above the plate 70. Thus, relatively warm or hot water may be discharged from the tank 7 at any time even when the device is repeatedly used at substantially short intervals while, at the same time, relatively cool water which has just been fed to the tank 7 is prevented from being directly discharged therefrom.

Finally, by virtue of the present vent tube 22, the user can visually determine from the outside of the device whether the interior of the tank 7 is filled with water, thereby serving the purposes of preventing the tank 7 with no water therein from being heated unawares and of detecting from outside of the device the exact level of water stored in the water reservoir 2.

I claim:

1. A device for serially dispensing cleansing tissues or the like which have been moistened to a predetermined degree with heated water, comprising a frame, a reservoir mounted within said frame for the storage of relatively cool water, a hot water heater positioned in said frame below said reservoir adapted to receive cool water from said reservoir and to discharge water therefrom heated to a predetermined temperature, a flexible water supply tube connecting said reservoir and said hot water heater, a flexible hot water discharge tube being mounted in said hot water heater with the upper end thereof projecting thereinto a preselected distance, a hot water supply chamber located in said frame below said hot water heater and the lower end of said hot water discharge tube extending into said chamber, an oscillatable throttling means being mounted within said frame adapted to oscillate between a first position whereby it constricts the passageway of said hot water discharge tube to prevent the discharge of hot water therefrom and a second position whereby it constricts the passageway of said water supply tube to prevent the flow of relatively cool water from said reservoir to said hot water heater, and means for storing a plurality of cleansing tissues and for moving same in a path within said frame whereby they are moistened by the hot water before being dispensed.

2. A device according to claim 1, wherein an operating lever in the form of a bell crank is pivotally mounted within said frame, return spring means being provided for biasing said operating lever towards a non-operational position, and said operating lever being manually actuable into its operational position, stop means being mounted within said frame for limiting the pivotal movement of said operating lever, a rocker arm being pivotally mounted within said frame operatively connected to said operating lever, said rocker arm carrying a throttling bar fixedly thereon at a location spaced from the pivot axis of said rocker arm, means being provided for operatively connecting said operating lever and rocker arm such that when said operating lever is biased into said non-operational position said rocker arm is thereby pivoted and said throttling bar is oscillated to said first position whereby it is urged against said hot water discharge tube to prevent the discharge of hot water therefrom, said connecting means being adapted, upon pivotal movement of said operating lever into the operational position thereof, to pivot said rocker arm and thereby oscillate said throttling bar to said second position whereby it is urged against said water supply tube to prevent the flow of relatively cool water from said reservoir to said hot water heater.

3. A device according to claim 2, wherein said means for operatively connecting said operating lever and rocker arm comprises a tension spring connected at one end thereof to one arm of the bell crank and at the other end thereof to the free end of said rocker arm, and a force accumulating lever mounted in said frame pivotable into the arcuate path of movement of said free end of said rocker arm and engageable with said operating lever, said force accumulating lever having a recess formed in the underside thereof for engagement of one shoulder of said recess with said free end of said rocker arm, positioning spring means being provided for biasing said force accumulating lever into said arcuate path of the rocker arm, the relative strengths of said return spring, tension spring and positioning spring and the disposition of said force accumulating lever relative to said arcuate path of the rocker arm and said operating lever being such that during the pivotal movement of said rocker arm and the consequent oscillation of said throttling bar from said second position towards said first position the movement of the free end of said rocker arm is momentarily arrested by engagement with said one shoulder of the recess, continued pivotal movement of said operating lever under the influence of said return spring effecting an engagement of said force accumulating lever by said operating lever, whereby said force accumulating lever is caused to pivot against the force of said positioning spring and the free end of said rocker arm is permitted to continue its movement to oscillate the throttling bar towards said first position, the momentary interruption of such movement enabling an accumulation of spring force to develop in said tension spring so as to rapidly oscillate the throttling bar to said first position and fully constrict the passageway of said hot water discharge tube.

4. A device according to claim 3, wherein a retainer plate is vertically carried by said frame within said hot water supply chamber, said operating lever being pivotally mounted at one side of said retainer plate, said rocker arm being pivotally mounted on the other side of said retainer plate, said retainer plate having an arcuate aperture therein, said free end of the rocker arm having a bent portion which extends through said arcuate aperture, and said tension spring being connected between said bent end and said one arm of the bell crank which constitutes said operating lever.

5. A device according to claim 1, wherein a stopper element is mounted on said frame and both of said water supply and discharge tubes extend through an aperture in said stopper element, said oscillatable throttling means being cooperable with said stopper element in the constriction of the passageways in said tubes.

6. A device according to claim 1, wherein said hot water discharge tube is adjustably mounted in said hot water heater so as to permit regulation of the volume of water to be discharged from said heater upon actuation of said operating lever.

7. A device according to claim 1, wherein said hot water heater comprises a tank, a vortex generator plate being mounted within said tank in spaced relation to the bottom thereof and adapted to produce an upwardly flowing vortex of water, the outlet end of said water supply tube terminating below said plate and the upper portion of said hot water discharge tube extending through said plate such that the upper end thereof opens into the section of the tank above said plate, whereby the water discharged from said tank is the relatively hot water within same and the cool water entering said tank from said reservoir is prevented from directly mixing with the relatively hot water therein.

* * * * *